United States Patent [19]

Kanetsuna et al.

[11] 3,946,094

[45] Mar. 23, 1976

[54] METHOD FOR MANUFACTURING FILAMENTS OF CRYSTALLINE PLASTICS THEREOF

[75] Inventors: Hisaaki Kanetsuna, Yokohama; Toshio Kurita, Tokyo, both of Japan

[73] Assignee: Agency of Industrial Science & Technology, Tokyo, Japan

[22] Filed: Aug. 22, 1974

[21] Appl. No.: 499,611

Related U.S. Application Data

[63] Continuation-in-part of Ser. No. 345,339, March 27, 1973, abandoned.

[30] Foreign Application Priority Data

May 30, 1972 Japan ..... 47-53511

[52] U.S. Cl. ..... 264/28; 264/178 F; 264/210 F; 264/290 R

[51] Int. Cl.[2] ..... B05B 3/00; D01D 5/24

[58] Field of Search ..... 264/28, 178 F, 210 F

[56] References Cited

UNITED STATES PATENTS

| | | | |
|---|---|---|---|
| 2,320,112 | 5/1943 | Wiley | 264/28 |
| 2,324,397 | 7/1943 | Hull | 264/178 F |
| 2,328,125 | 8/1943 | Buchsbaum et al. | 264/28 |
| 2,352,861 | 7/1944 | Pierce | 264/28 |
| 2,354,744 | 7/1944 | Dreyfus | 264/28 |
| 2,452,080 | 10/1948 | Stephenson | 264/28 |
| 2,846,289 | 8/1958 | Gray | 264/28 |
| 3,002,804 | 10/1961 | Kilian | 264/178 F |
| 3,054,652 | 9/1962 | Hermann | 264/28 |
| 3,361,728 | 1/1968 | Coen et al. | 264/28 |

FOREIGN PATENTS OR APPLICATIONS

| | | | |
|---|---|---|---|
| 1,095,750 | 12/1967 | United Kingdom | 264/28 |

*Primary Examiner*—Jay H. Woo
*Attorney, Agent, or Firm*—Oblon, Fisher, Spivak, McClelland & Maier

[57] ABSTRACT

In melt spinning a crystalline plastic material such as, for example, nylon 6, molten filaments discharged through the spinneret are drafted at a mathematical draft of not less than 3 and, while being so drafted in their molten state, are abruptly cooled to a temperature below −30°C, whereby the microbrownian motion of the molecules in the filaments is frozen while the molecules in the filaments are retained in a specific oriented state. When the filaments in which the molecules are oriented in a fixed direction and hence the chains of molecules are in a readily stretchable state are further subjected to a stretching treatment at a temperature at which the microbrownian motion of molecules remains frozen, there are produced filaments possessed of mechanical strengths far exceeding those exhibited by filaments which are spun and stretched by the conventional method.

2 Claims, 4 Drawing Figures

METHOD FOR MANUFACTURING FILAMENTS OF CRYSTALLINE PLASTICS THEREOF

REFERENCE TO COPENDING APPLICATION

This is a continuation-in-part of our copending application U.S. Ser. No. 345,339, filed Mar. 27, 1973 and now abandoned.

BACKGROUND OF THE INVENTION

This invention relates to filaments of crystalline plastics possessed of excellent mechanical properties because of a stretching treatment and to a method for the manufacture of such filaments.

In producing filaments by the melt spinning of a plastic material, there has generally been practiced a method whereby the filaments discharged through the spinneret are sent through a spinning tower and taken up in the form of unstretched filaments and the unstretched filaments are subsequently subjected to a stretching treatment for conversion into stretched filaments. Thus, the properties exhibited by the resultant stretched filaments have substantially depended on the properties of the plastic material used as the starting material. Very seldom have these properties been capable of being improved by the spinning process.

U.S. Pat. No. 2,846,289 discloses a method for the manufacture of clear filaments with a surface gloss, which method comprises rapidly cooling polyamide filaments discharged through the spinneret to a temperature below −5°C and subsequently subjecting the filaments to a stretching treatment at normal room temperatures. The filaments manufactured by this method are transparent and have a surface gloss and, therefore, are suitable for specific uses such as in brushes and fishing lines. They, nevertheless, are scarcely improved in terms of tensile strength.

It is a primary object of this invention to provide filaments which are transparent and are possessed of a glossy surface and pronouncedly improved mechanical strengths and a method for the manufacture of such filaments.

SUMMARY OF THE INVENTION

To accomplish the said object, this invention causes molten filaments of a crystalline plastic material discharged through the spinneret to be drafted at a mathematical draft of not less than 3 and, while being so drafted, cooled rapidly, whereby the microbrownian motion of the molecules within the filaments is frozen while the molecules in the filaments are retained in a specific oriented state. The temperature at which this freezing is effected varies with the particular kind of crystalline plastic material used: It is desired to be below about −30°C in the case of polyamide and below about −70°C in the case of polyolefine such as polyethylene or polypropylene. Even though the filaments which have been vitrified as described above have an apparently unoriented, amorphous glassy state, they actually have their chains of molecules so oriented as to suit the convenience of the subsequent stretching treatment. When the said frozen filaments are subjected to a stretching treatment at a low temperature, specifically below 10°C in the case of polyamide or below −18°C in the case of polyolefine, (hereinafter referred to briefly as "low-temperature stretching treatment"), they convert themselves into clear filaments possessed of highly improved mechanical properties.

The other objects and characteristics of the present invention will become apparent from the description given in further detail herein below with reference to the accompanying drawing.

DETAILED DESCRIPTION OF THE INVENTION

Figure 1:
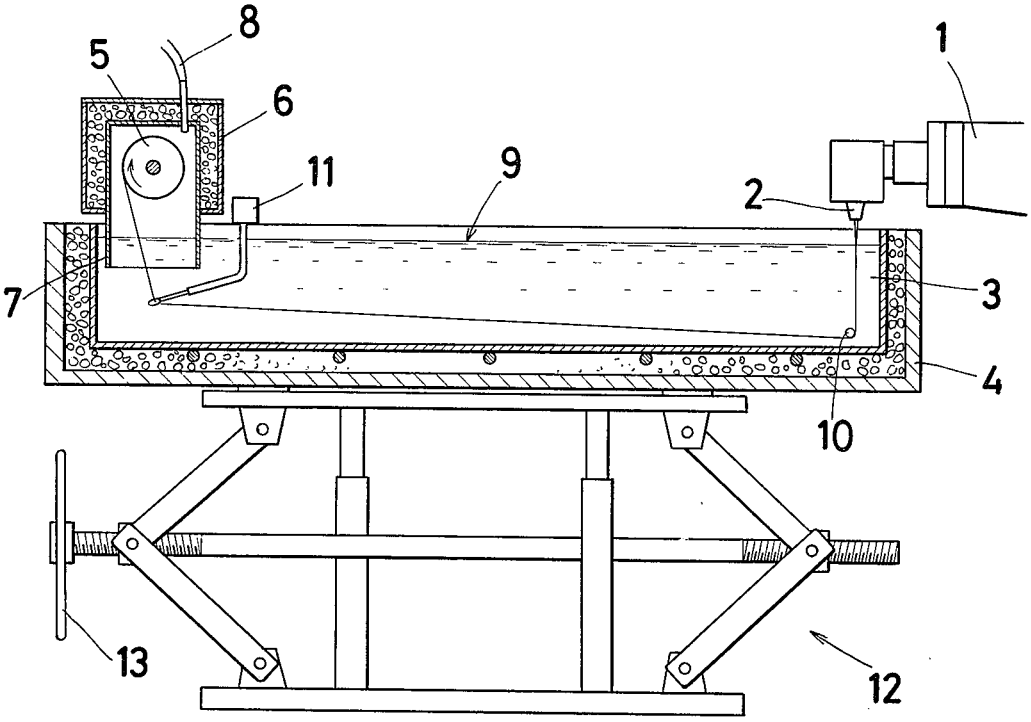
FIG. 1 is one preferred embodiment of the apparatus for practicing the method of this invention.

The inventors conducted a series of studies on filament spinning conditions with a view to obtaining stretched filaments having excellent properties. Consequently they have made the following discovery: When molten filaments discharged through the spinneret are drafted at a mathematical draft of not less than 3 and, while being so drafed, cooled instantaneously to a temperature below at least the glass transition temperature, the filaments, even if apparently in an unoriented, amorphous glassy state, have an increased free volume in the amorphous glassy polymers and the chains of molecules are in such a state as to be readily disentangled and oriented by a stretching treatment or they are oriented in a substantially disentangled state. When the filaments in such state are further subjected to a low-temperature stretching treatment while being prevented from rising above at least the glass transition temperature, they are readily stretched in their transparent state to give birth to filaments wherein chains of molecules assume an oriented state. The filaments thus stretched are found to be possessed of mechanical strengths far exceeding those exhibited by stretched filaments obtained by the conventional method in which the treatment is given at normal room temperatures.

In producing filaments by the melt spinning of a plastic material, the filaments discharged through the spinneret have heretofore been stretched at or above normal room temperatures. It has to date been accepted that at normal room temperatures, filaments become too brittle to withstand a stretching treatment or, if they can withstand a stretching treatment at all, the resultant filaments become too opaque to suit their intended uses.

Generally, a crystalline plastic material has the optimum crystallizing temperature zone slightly below its melting point. It has its cold crystallization zone slightly above its glass transition temperature. Crystallization of the crystalline plastic material proceeds in the two crystallizing temperature zones and in the intermediate temperature zone. In the case of a plastic material which is made fluid, the preferable crystallizing temperature zone generally shifts to the higher temperature side and what is generally referred to as "oriented crystallization" takes place in this zone.

During such crystallization of a plastic material, there is generally observed an induction period. If the molten plastic material falls past the crystallizing temperature zone and reaches a temperature below the glass transition temperature within a period sufficiently shorter than the said induction period, then the molecules of the plastic material are frozen in the same state as they existed while the plastic was still in the molten state. Thus, the molten plastic material assumes an amorphous, glassy state. If, during the melt spinning of a plastic material, molten filaments in a fluid state are instantaneously brought down to a temperature below the glass transition temperature, then there are formed amorphous, orientable, glassy filaments reflecting the rate of deformation as described above. The present invention has been accomplished on the basis of this principle. In the amorphous, orientable, glassy filaments wherein the microbrownian motion of molecules has been frozen by the aforementioned treatment, the molecules are maintained in a state convenient for the filaments' low-temperature stretching treatment. If these filaments are subjected further to a low-temperature stretching treatment while being prevented from rising above at least the glass transition temperature, then they are readily stretched without having their transparency impaired to give rise to filaments which are excellent in mechanical strengths.

The method of the present invention will be described in further detail with reference to the accompanying drawings.

FIG. 1 is one preferred embodiment of the apparatus for practicing the method of this invention. The spinneret 2 of a spinning machine 1 is disposed above one end of a freezing bath 3 covered on the outside thereof with a suitable heat insulating material 4. Above the other end of the freezing bath, there is disposed a rotary drum 5. Within the freezing bath, there are provided a guide roller 10 and a thread guide 11 respectively below the nozzle 2 and the rotary drum 5. The rotary drum is housed in a tightly closed container 6 cooled with dry ice placed on the outside thereof. The lower open end of the said container is extended at least to such an extent as to be submerged in the medium in the freezing bath. Above the said container, there is provided an inlet for delivery of inert gas to the filament such as $N_2$ gas. Low-temperature $N_2$ gas is delivered through this inlet into the container to isolate the rotary drum from the ambient air. The freezing bath is placed on a support stand 12 adapted to be moved vertically by the revolution of a handle 13. The vertical movement of the freezing bath permits free adjustment of the distance from the surface of the medium 9 held in the bath to the nozzle 2 of the spinneret.

The molten plastic material within the spinning machine 1 is spun through the spinneret 2 and led into the freezing bath 3. The freezing bath contains a medium such as, for example, n-hexane or n-octane and is covered on the outside with a suitable heat insulating material. The space formed between the exterior surface of the freezing bath and the interior surface of the heat insulating material is filled with dry ice or some other suitable refrigerant which serves the purpose of cooling to and maintaining at a predetermined temperature the medium held in the freezing bath. The molten filaments discharged through the spinneret are immediately frozen on entering the freezing bath, forwarded past the guide roll and the thread guide and finally taken up on the rotaray drum which is disposed above the freezing bath, isolated from the ambient air by the low-temperature $N_2$ gas and cooled with dry ice. In this illustrated embodiment, the rotary drum 5 is positioned above the freezing bath. Optionally this rotary drum may be disposed directly inside the freezing bath.

The plastic materials used for the present invention have only to satisfy the requirement that they are crystalline and are capable of being spun in the form of filaments. No other special limits are imposed. Examples of such plastic materials are various nylon homologues, various polyolefins such as polypropylene and polyethylene, and various polyesters.

For the present invention, the manner in which the molten filaments spun out of the spinneret are rapidly cooled constitutes one important factor. With the heat conduction left out of consideration, the molten filaments, if introduced into a coolant at a temperature below the glass transition temperature, would naturally be lowered immediately to a temperature below the glass transition temperature and vitrified, with the microbrownian motion of the molecules thereof frozen consequently. However, since plastic materials actually have fairly low degrees of heat conductivity, it inevitably takes some length of time for the filaments to be frozen to their core.

The temperature at which the crystalline plastic material is usually melt spun is 260° – 300°C. When the filaments at this temperature are introduced into the freezing bath, they are cooled inwardly from their surface. In order for these filaments to be rapidly cooled sufficiently to their core, therefore, the freezing bath must be at a temperature far lower than the glass transition temperature of the plastic material. In this respect, the temperature of the freezing bath is desired to be below −30°C. The bath temperature which is below the glass transition temperature but is above −30°C is not desirable, because at such temperature, the length of cooling time is much greater than when the temperature is below −30°C.

If the filaments have a large diameter, the temperature of the freezing bath is required to be proportionally lowered. In melt spinning nylon 6 or nylon 66 at a draft ratio of 3.7, by the use of a spinneret with orifices 0.5mm in diameter, for example, there is used a freezing bath which is kept at −75°C with dry ice. Since the advantage of the medium of freezing bath increases with the magnitude of heat capacity thereof, the use of a liquid medium is preferred to that of a gaseous medium. If the medium is such that, when the molten filaments are plunged into the medium, the heat from the filaments vaporizes the medium and the vaporized medium covers the surface of filaments, there is a consequent degradation of the cooling efficiency. For this reason, the boiling point of the medium is desired to be as high as permissible. Desirably the medium is deprived of any dissolved gas entrained thereby, for such gas covers the surface of filaments to bring forth the same undesirable effect as mentioned above. Further, the medium is required to be so inert as not to swell or crystallize the crystalline plastic material in use. In the case of nylons, for example, it is possible to use paraffinic hydrocarbons such as n-hexane, n-octane and petroleum fractions refrigerated with dry ice to required temperatures. In this case, it is undesirable to have the freezing medium exposed to direct contact with the dry ice, because the carbon dioxide dissolved in the medium covers the surface of the molten filaments to degrade the freezing efficiency. If dry ice is used as the refrigerant, therefore, it is desirable to have the freezing bath refrigerated indirectly with dry ice placed on the outside of the bath as shown in FIG. 1.

For the spinning of polyolefins such as polypropylene and polyethylene, there can be used alcohols such as ethanol and methanol. For polyesters, there are used carbon tetrachloride, n-hexane, n-butyl alcohol, ethyl alcohol, etc. These media may be used either independently or in the form of a mixture.

A freezing bath is cooled to and maintained at a predetermined temperature by use of dry ice or some other commonly used refrigerant. As to the manner of cooling, the freezing bath containing a medium may be cooled externally by means of a refrigerant which is placed around the exterior surface of the freezing bath as illustrated in FIG. 1. Alternatively, if the refrigerant to be used is of a type which reacts with neither the crystalline plastic material nor the medium, it may be placed in conjunction with the medium within the bath to cool the medium directly.

Generally, the spun filaments come to show increasingly more improved stretchability and molecule-orienting property in the low-temperature stretching treatment to be described afterward in proportion to the increase in the rate of deformation of spinning.

The rate of deformation of the spinning increases with the increasing draft ratio or the increasing ratio of the cross-sectional area of the orifices in the spinneret to the cross-sectional area of the filaments after completion of the spinning. It is before the filaments are vitrified, namely from the time the molten filaments emanate from the spinneret to the time they enter the freezing bath that the filaments are subjected to drafting. The filaments are immediately frozen on entering the freezing bath and they substantially do not undergo stretching while in the bath. The draft ratio is determined by the diameter of the orifices in the spinneret, the amount of molten filaments discharged and the revolution number of the rotary drum. Practically, the effect of drafting is conspicuously manifested when the draft ratio is 3 or over. Little effect is observed, however, when the draft ratio fails to reach 3. As today's technical standard goes, the upper limit of the draft ratio is about 1000. This, however, does not necessarily imply that the draft ratio has this as its specific upper limit. That is, the draft ratio may be as high as permissible.

This rate of deformation of spinning increases with the decreasing distance between the spinneret and the liquid surface of the freezing bath. For this reason, the distance between the spinneret and the liquid surface of the freezing bath is desired to be not more than 20cm. In the apparatus illustrated in FIG. 1, the distance from the spinneret to the liquid surface of the freezing bath can be adjusted by means of the support base which is movable vertically. The desired adjustment of the said distance may otherwise be accomplished by adapting the spinneret to be vertically movable.

In the melt spinning of a crystalline plastic material, this invention subjects the molten filaments emanating from the spinneret to drafting at a draft ratio of not less than 3 and, while the molecules within the filaments are maintained in a molten state, cools them suddenly so as to freeze the microbrownian motion of molecules and terminate the vitrification prior to formation of a crystalline state. Thus, the molecules within the filaments are frozen while in a specific oriented state. Consequently, the frozen filaments have a suitable degree of flexibility even at a temperature much lower than the glass transition temperature and can be easily taken up on a cooled takeup drum. In the amorphous, orientable, glassy filaments thus obtained, the molecule chains are arranged in such a way that the filaments will readily be stretched at a temperature far lower than the glass transition point. These filaments tend to bring about a change in the glassy state or cause the phenomenon of low-temperature crystallization when they are suffered to rise to or past the glass transition temperature. It is therefore necessary that they be maintained at a temperature lower than the glass transition point at least until they are supplied to the subsequent steps of treatment.

The amorphous, orientable, glassy filaments obtained as described above are recognized to have hardly any molecular orientation in accordance with the results of X-ray diffraction and birefringence measurement. Yet, differential scanning calorimetry reveals that, in these filaments, the exothermic peak due to the so-called cold crystallization appears in quite a different pattern from that which is observed in ordinary amorphous masses of crystalline polymers and that the initial temperature of heat generation shifts to the low temperature side as if there had occurred a molecular orientation. In addition, the filaments are characterized by the fact that a double peak makes its appearance as the drafting ratio is increased to a certain level.

As described above, the amorphous, orientable, glassy filaments according to the present invention can easily be subjected to the low-temperature stretching treatment. In this respect, they differ from ordinary unstretched filaments. When unstretched filaments obtained by the conventional method are subjected to a low-temperature stretching treatment, they undergo the phenomenon of opacification to assume a state no longer suitable for intended uses. By contrast, the amorphous, orientable, glassy filaments provided by the present invention retain their transparency intact and have their various properties improved by the low-temperature stretching treatment.

In the melt spinning of a crystalline plastic material, filaments excellent in mechanical strengths can be manufactured by drafting at a draft ratio of not less than 3 the molten continuous plastic threads emanating from the spinneret, introducing them, while the continuous threads are still in the molten state and are maintained in a taut state, into the freezing bath at a temperature below −30°C for thereby allowing the filaments to be vitrified completely before they have enough time for formation of the crystalline state, subjecting the vitrified filaments to a low-temperature stretching treatment and thereafter elevating them to a temperature above the glass transition temperature.

This stretching treatment is performed at such a low temperature that the amorphous, orientable, glassy filaments acquire as satisfactory a molecular orientation as possible without inducing any variation in the glassy state or undergoing crystallization during the period of stretching treatment.

To be more specific, the said low temperature is desirably below 10°C for polyamide, and below −18°C for polyethylene or polypropylene in consideration of the fact that the glass transition temperature varies with the particular kind of plastic material in use and the stretching treatment entails evolution of heat.

The medium of the freezing bath used for the purpose of this stretching treatment may be gaseous or liquid so long as there is satisfied the requirement that the medium is inert to the filaments similarly to the freezing bath used for freezing the emanating filaments. Examples of such media are air, n-hexane and alcohols.

Figure 2:
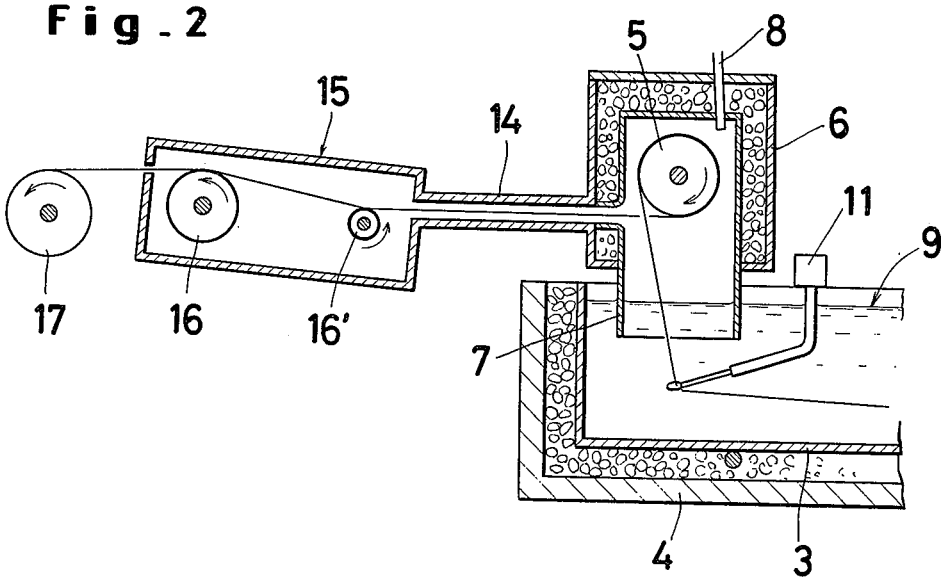
FIG. 2 is another embodiment of the apparatus for practicing the method of this invention.

FIG. 2 illustrates an embodiment in which the aforementioned method of low-temperature stretching treatment is practiced by use of the apparatus of FIG. 1. To the tightly closed container 6 provided with a rotary drum, there is connected a low-temperature stretching compartment 15 via a passage 14. The amorphous, orientable, glassy filaments wound on the rotary drum 5 are unwound and forwarded through the passage 14 to the low-temperature stretching compartment 15 and stretched by the rolls 16 and 16'. At the same time, a cooled inert gas from a tightly sealed container flows through the passage 14 into the stretching compartment 15 to have the stretching compartment 15 cooled to and maintained at a predetermined temperature. The filaments which have thus been subjected to a stretching treatment at the low temperature are taken up on the roll 17. This takeup roll 17 is not required to be maintained at a low temperature. The orientation of molecules is improved and the breaking strength is enhanced in proportion as the stretching ratio increases. It is, therefore, advantageous that the stretching ratio be increased as much as possible. Generally, the stretching is made to cover 4 times in the case of nylon 6 and nylon 66, over 8 times in the case of polyethylene, over 7 times in the case of polypropylene and over 4 times in the case of polyethylene terephthalate.

Of course the low-temperature stretching treatment may be carried out batchwise. For example, a fixed amount of amorphous, orientable, glassy filaments wound on a rotary drum may be transferred into a low-temperature compartment while being maintained by a suitable method at a temperature lower than the glass transition temperature and then subjected to a stretching treatment within the said low-temperature compartment.

Filaments excellent in breaking stength can be manufactured by having the molecules within the filaments oriented before they have reached the stage of crystallization and subsequently allowing the stretched filaments to rise above the glass transition temperature so as to undergo crystallization as described above. Optionally, the filaments to be obtained by the method of the present invention may further be stretched by an ordinary method.

DESCRIPTION OF THE PREFERRED EMBODIMENTS

Some preferred embodiments of this invention will be described herein below. These examples are not to be considered to limit the present invention.

EXAMPLE 1

A fiber-grade nylon 6 melted by heating to 265°C was melt spun through a spinneret with orifices 0.5mm in diameter at an output rate of 3.4 g/min/orifice. The molten filaments were introduced to be frozen in a freezing bath containing n-hexane at −75°C and placed at a distance of 6.2cm from the spinneret and the frozen filaments were taken up on a rotary drum disposed in the freezing bath. Amorphous, orientable, glassy filaments with different drafting ratios indicated in Table 1 were obtained by varying the revolving speed of the drum. The filaments thus obtained were tested for birefringence, X-ray diffraction, differential scanning calorimetry, breaking strength and elongation at about −6°C. Of the results of the measurements described above, those of birefringence and X-ray diffraction are shown in Table 1 below.

Table 1

| Draft ratio | Birefringence | X-ray diffraction |
|---|---|---|
| 3.7 | 0.245 × $10^{-3}$ | Halo ring indicative of amorphous, and of absence of oriented molecular arrangement |
| 9.3 | 0.327 " | " |
| 11.5 | 0.480 " | " |
| 12.0 | 0.528 " | " |
| 15.9 | 0.525 " | " |
| 16.8 | 0.479 " | " |
| 29.4 | 0.777 " | " |

As is clear from the table, the filaments obtained by the procedure described above are indicated by the X-ray diffraction images to be completely amorphous and unoriented. The magnitudes of the birefringence are very small and they are seen to tend to increase slightly with an increase in the drafting ratio.

Figure 3:
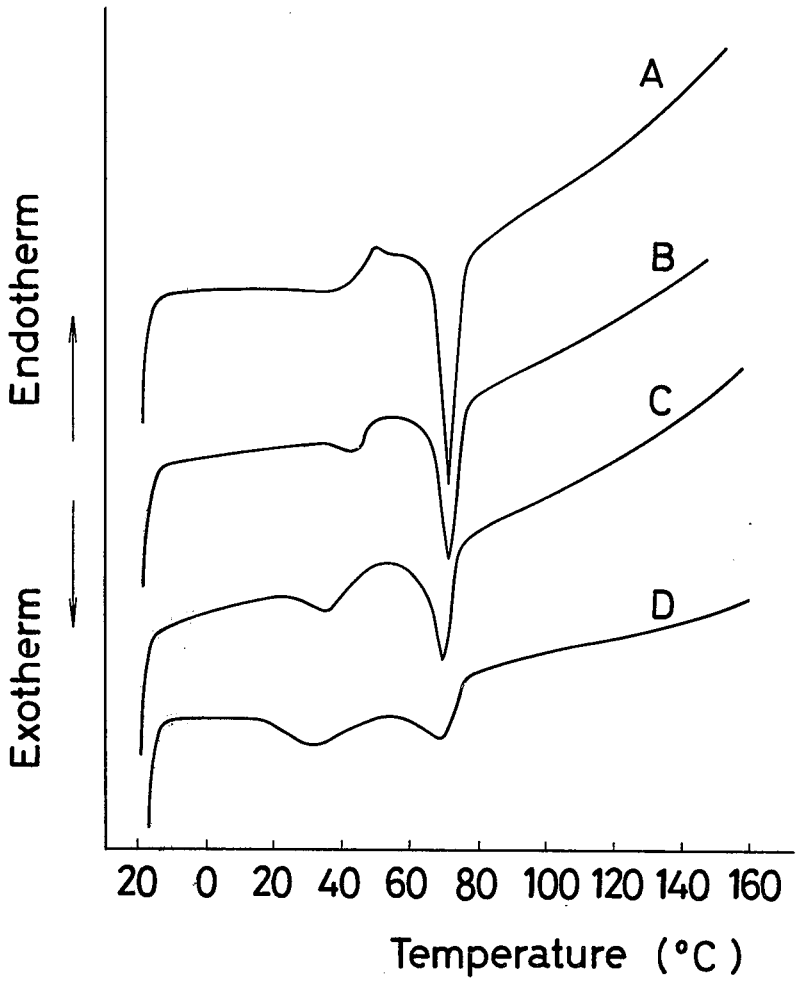
FIG. 3 is a graph showing differential scanning calorimetry curves (DSC curves) of orientable, glassy amorphous nylon-6 filaments obtained in accordance with the present invention at varying drafting ratios.
Figure 4:
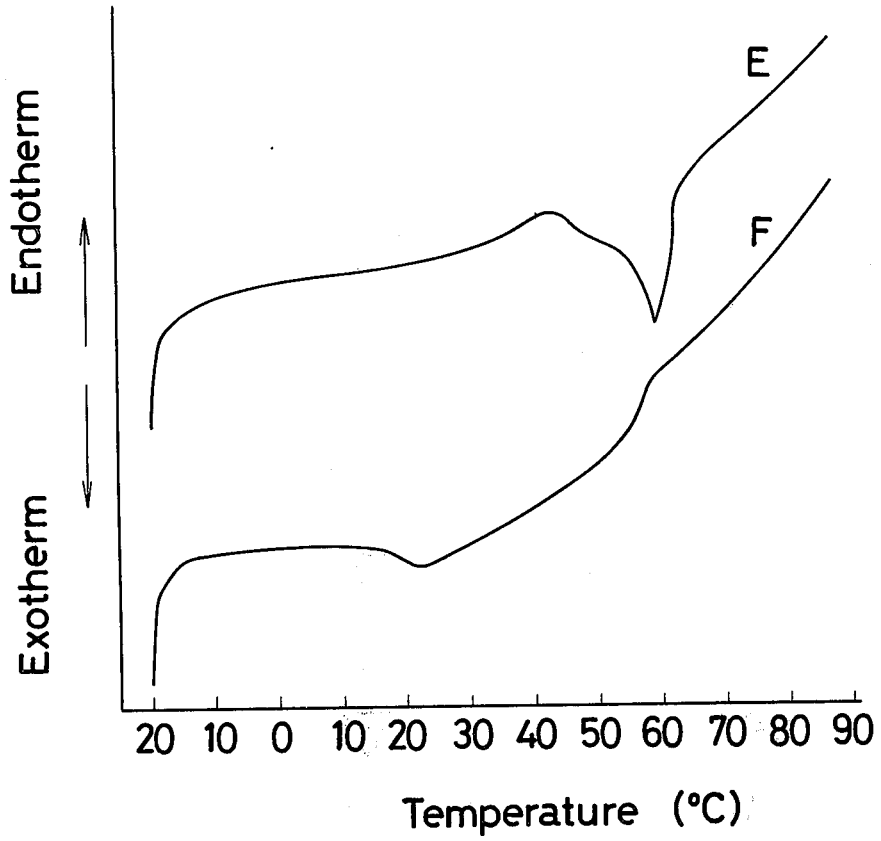
FIG. 4 is a graph showing DSC curves of a part of the filaments of FIG. 3, with the rate of temperature increase varied.

A 10-mg specimen of each run of filaments having a different draft ratio was tested for differential scanning calorimetry. The results obtained at a rate of temperature increase of 16°C/min are plotted as DSC curves in FIG. 3. In the graph, curve "A" represents the filaments with a draft ratio at 3.7, curve "B" those with a draft ratio of 11.5, curve "C" those with a draft ratio of 15.9 and curve "D" those with a draft ratio of 29.4 respectively. FIG. 4 shows the results of the DSC measurement performed with the rate of temperature increase at 2°C/min. In this graph, curve "E" represents the filaments with a draft ratio of 3.7 and curve "F" those with a draft ratio of 29.4 respectively.

As is evident from these graphs, the DSC curves broadly differ depending on the difference of draft ratios. In the case of filaments which involve smaller draft ratios, the DSC curves described in the course of what is called glass transition are biased toward the endothermic side showing slight rises of curve, then form exothermic peaks for what is called cold crystallization and further show slight signs of exotherm immediately before the point where the DSC curves are biased toward the endothermic side representing the glass transition. In the case of filaments involving larger draft ratios, the temperatures at which the exotherm for cold crystallization starts apparently shift gradually toward the low-temperature side and, at the same time, the amounts of heat generation prior to glass transition gradually increase. Eventually, the two exothermic peaks come to overlap each other to give rise to a double peak covering a wide temperature zone. If, in this case, the temperature is elevated at a slow speed in the DSC measurement, there may appear a triple peak instead of the double peak because of possible decrease in the sharpness of dips in the curves. The said phenomenon that the double exothermic peak covering a wide temperature range appears as the initial temperature of exotherm for cold crystallization shifts to the low-temperature side is similar to that which is observed in the case of the cold crystallization of low crystalline polymers having oriented molecules.

The filaments obtained in this example were further tested for breaking strength and elongation at a temperature of about −6°C. The results of the test are shown in Table 2 below, in comparison with the results obtained similarly with unstretched filaments of the conventional method.

Table 2

| | Draft ratio | Yield stress (kg/mm²) | Stress during neck stretching (kg/mm²) | Elongation before breaking (times) | Breaking strength (kg/mm¹) | State of stretched filament |
|---|---|---|---|---|---|---|
| Unstretched filaments of conventional method | — | 8.6 | 6.6 | 3.57 | 7.7 | Opacified in stripes |
| Frozen filaments | 1.0 | 5.0 | 4.3 | 4.50 | 8.5 | transparent |
| | 3.7 | 5.0 | 4.3 | 5.70 | 11.4 | " |
| | 9.3 | 4.7 | 4.3 | 5.43 | 11.6 | " |
| | 11.5 | 5.1 | 4.5 | 5.93 | 12.7 | " |
| | 12.0 | 4.7 | 4.2 | 5.37 | 11.2 | " |
| | 15.9 | 4.2 | 4.0 | 5.34 | 10.7 | " |
| | 16.8 | 4.4 | 4.0 | 5.15 | 11.0 | " |
| | 29.4 | 4.2 | 4.0 | 4.72 | 10.8 | " |

From this table, it is seen that the frozen filaments obtained by the present invention show conspicuously low yield stress and neck-elongation stress and a markedly high elongation percentage before breaking as compared with unstretched filaments produced by the conventional method. Further, the frozen filaments with draft ratios of more than 3 show decidedly higher elongation percentage and strength before breaking than those with a draft ratio of 1.

In the course of neck stretching, the conventional unstretched filaments are stretched while being intermittently opacified, so that the curves of strength and elongation described are accordingly zigzagged. The frozen filaments of the present invention are stretched uniformly while retaining their transparency. The conventional unstretched filaments break as soon as the neck stretching is terminated and the strength at the moment of this breaking is low. The frozen filaments of this invention continue to be stretched and at the same time gain in stress proportionally even after termination of the neck stretching. Also, the strength which they exhibit at the time of breaking is far greater than that obtained with the conventional unstretched filaments.

As described above, the conventional unstretched filaments are difficult of stretching at temperatures below the room temperature and, if stretched at all, produce opacified zones in stripes. Thus, they are no longer suitable for practical use when they are stretched at such low temperatures. The frozen filaments with draft ratios of more than 3 according to the present invention are characterized in that they are easy of stretching even at temperatures lower than the room temperature and retain their transparency unopacified in the course of stretching.

EXAMPLE 2

Of the various types of amorphous, orientable, glassy filaments obtained with different draft ratios in Example 1, four types were selected. The specimen of each type was stretched to its critical point by the use of a stretching apparatus maintained at about −6°C. The stretched specimen in this state was elevated to 100°C, then left to stand at that temperature for 10 minutes and thereafter tested for breaking strength and elongation under conditions of 20°C of temperature and 65% of humidity. Separately, the filament obtained with draft ratio of 29.4 by the procedure of Example 1 was held at 22°C for 3 days, thereafter stretched to its critical point at 50°C, a temperature exceeding the glass transition temperature and, while fixed in that state, allowed to stand at 100°C for 10 minutes, and then tested for breaking strength and elongation under conditions of 20°C of temperature and 65% of humidity. The results are shown in Table 3. In the table, the "critical elongation ratio" refers to the lowest meter reading at which any one of a total of 10 filaments being simultaneously stretched was broken.

Table 3

| Treatment | Draft ratio | Critical stretching ratio (times) | Birefringence ($\times 10^{-3}$) | Breaking strength (kg/mm²) | Elongation (%) |
|---|---|---|---|---|---|
| Stretched at −6°C and treated at 100°C | 1.4 | 4.0 | — | 52.8 | 41.9 |
| | 3.7 | 4.5 | — | 66.8 | 56.0 |
| | 11.5 | 4.7 | 54.2 | 67.9 | 41.8 |
| | 29.4 | 4.6 | 55.7 | 72.7 | 28.5 |
| Stretched at 50°C and treated at 100°C | 29.4 | 3.6 | 54.5 | 49.7 | 43.8 |

As is clear from this table, the filaments obtained by stretching at −6°C the amorphous, orientable, glassy filaments spun at draft ratios over 3 and allowing them, in their fixed state, to stand at 100°C for 10 minutes show a higher strength than ordinary nylon filaments and enjoy a relatively high elongation. The filaments involving draft ratios below 3 and those stretched at a temperature over the glass transition temperature show the same degree of strength as ordinary nylon filaments.

EXAMPLE 3

Nylon 66 melted by heating to 280°C was melt spun through a spinneret with orifices 0.5mm in diameter at an output rate of 1.5 to 2 g/min/orifice. The molten filaments emanating from the spinneret were introduced to be frozen in a freezing bath filled with n-hexane at −75°C and disposed at a distance of 3cm from the spinneret. They were taken up on a rotary drum disposed within the freezing bath at a distance of about 40cm from the spinneret, with the draft ratio varied as indicated in Table 4. By a stretching treatment given at about −6°C, the filaments thus obtained could be stretched to more than five times the original length, with their transparency retained intact. These filaments were tested for birefringence and X-ray diffraction.

The results are shown in Table 4. The DSC curves for these filaments are substantially the same as those of nylon 6 even at increased drafting ratios.

Table 4

| Draft ratio | Birefringence ($\times 10^{-3}$) | X-ray diffraction |
|---|---|---|
| 4.8 | 0.08 | Halo ring indicative of amorphous, and of absence of oriented molecular arrangement |
| 6.2 | 0.13 | " |
| 11.7 | 0.18 | " |
| 28.0 | 0.66 | " |

EXAMPLE 4

Polyethylene was melt spun through a spinneret with orifices 0.3mm in diameter at 278°C at an output rate of 1.9 g/min/orifice. The molten filaments emanating from the spinneret were introduced to be frozen in a freezing bath using ethanol as the medium at about −100°C and placed at a distance of 3.0cm from the spinneret and the frozen filaments were taken up at a draft ratio of about 10 on a rotary drum disposed within the freezing bath at a distance of about 40cm from the spinneret. The filaments thus obtained could be stretched to more than 8 times the original length without entailing the phenomenon of necking in ethanol at −80°C, with the transparency retained intact.

EXAMPLE 5

Polypropylene was melt spun through a spinneret with orifices 0.5mm in diameter 270°C at an output rate of 1.7 g/min/orifice. The molten filaments emanating from the spinneret were introduced into a freezing bath of ethanol kept at about −90°C. The surface of the freezing bath was at a distance of about 3cm from the spinneret. On a rotary drum disposed within the freezing bath, the filaments were taken up at a draft ratio of about 12. The filaments thus obtained could be stretched to more than 7 times the original length in ethanol at −50°C.

EXAMPLE 6

High-viscosity nylon 6 was melt spun through a spinneret with orifices 0.5mm in diameter at 280°C at an output rate of 0.3 g/min/orifice. The formed filaments were introduced to be frozen in a freezing bath of n-hexane at −75°C placed at a distance of 6cm from the spinneret. On a rotary drum disposed within the freezing bath, the frozen filaments were taken up at a draft ratio of 123 to obtain transparent filaments. Then, the filaments were stretched at about −7°C to the critical point, elevated to 100°C while still fixed on the stretching unit, and then left to stand at this temperature for 10 minutes. The stretched filaments thus produced were tested for birefringence, breaking strength and elongation under conditions of 20°C of temperature and 65% of humidity. The critical stretching ratio was found to be 4.5 times the original length, the birefringence to be $64 \times 10^{-3}$, the strength to be 100.0 kg/mm$^2$ and the elongation to be 21%.

Filaments which were spun from high-viscosity nylon 6 by the conventional process were heavily opacified when they were stretched even at normal room temperatures. The filaments obtained by the procedure of this example retained the transparency even when they were stretched at a temperature below the room temperature.

EXAMPLE 7

High-viscosity nylon 6 melted by heating to 300°C was melt spun through a spinneret with orifices 0.5mm in diameter at an output rate of 3.0 g/min/orifice. The molten filaments emanating from the spinneret were introduced to be frozen in a freezing bath filled with n-hexane at −75°C and disposed at a distance of 15 cm from the spinneret. They were taken up at a draft ratio of 16.4 on a rotary drum within a closed vessel disposed directly above the freezing bath and maintained at −40°C with the gas vaporized from liquid nitrogen.

The frozen filaments thus obtained were stretched to 4 to 4.7 times the original length at temperatures of −10°C, 0°C, 10°C, 20°C and 30°C. The resultant stretched filaments were subsequently stretched at 130°C to 1.2 to 1.3 times and again stretched at 180°C to 1.2 to 1.3 times. The filaments which had undergone the stretching treatments were tested for breaking strength and elongation under conditions of 20°C of temperature and 65% of humidity. The results are shown in Table 5.

Table 5

| Temperature of first stretching treatment (°C) | Breaking strength (kg/mm$^2$) | Elongation (%) |
|---|---|---|
| −10 | 95.1 | 31.5 |
| 0 | 95.0 | 33.2 |
| 10 | 94.2 | 30.1 |
| 20 | 85.1 | 30.9 |
| 30 | 86.7 | 31.1 |

From the table, it is clear that the filaments which undergo the first stretching treatment at temperatures of not more than 10°C acquire higher degrees of breaking strength.

EXAMPLE 8

The apparatus of Example 7 was used. High-viscosity nylon 6 melted by heating to 280°C was melt spun through the spinneret with orifices 0.5mm in diameter at an output rate of 0.2 g/min/orifice. The molten filaments emanating from the spinneret were introduced to be frozen in the freezing bath disposed at a distance of 3cm from the spinneret and adjusted to two temperatures of 0°C and −30°C. They were taken up at draft ratios of 500 and 950.

The frozen filaments thus obtained were stretched at −20°C and −70°C to the critical point. Subsequently, they were further stretched at 130°C to 1.1 to 1.3 times the original length and again stretched at 155°C to 1.1 to 1.3 times. The filaments which had undergone the stretching treatments were tested for breaking strength and elongation under conditions of 20°C of temperature and 65% of humidity. The results are shown in Table 6.

Table 6

| Draft ratio | Temperature of freezing bath (°C) | Temperature of first stretching treatment (°C) | Breaking strength (kg/mm$^2$) | Elongation (%) |
|---|---|---|---|---|
| 500 | −30 | −20 | 104 | 21.1 |
| 950 | −30 | −70 | 102 | 23.2 |
| 500 | 0 | −20 | 84 | 20.8 |

It is clear from the table that the filaments which undergo the freezing treatment at 0°C show a breaking strength about 15% inferior to that shown by the filaments which undergo the same treatment at −30°C, although the other conditions of treatment are entirely the same.

EXAMPLE 9

The apparatus of Example 7 was used. A fiber-grade isotactic polypropylene melted by heating to 280°C was melt spun through the spinneret into the freezing bath of ethanol at about −90°C disposed at a distance of 5cm from the spinneret and then taken up on a rotary drum within the closed vessel maintained at −50°C with the gas vaporized from liquid nitrogen. The spinneret had orifices 0.5mm in diameter. The output rate of filaments through the spinneret per orifice and the take-up speed of filaments on the rotary drum were so adjusted that the filaments were drafted at draft ratios of 1.2, 3.2, 40, 120 and 800.

The frozen filaments of varying descriptions thus obtained were stretched at the varying temperatures indicated in Table 7 to their critical point and, while they were maintained in the resultant taut state, subjected to a heat treatment by being elevated to 110°C. The filaments which had undergone these treatments were tested for breaking strength and elongation under conditions of 20°C of temperature and 65% of humidity. The results are shown in Table 7.

Table 7

| Draft ratio | Temperature of stretching treatment (°C) | Breaking strength (kg/mm²) | Elongation (%) |
|---|---|---|---|
| 1.2 | −20 | 70 | 25 |
| 3.2 | −20 | 91 | 30 |
| 40 | 0 | 65 | 23 |
| 40 | −20 | 94 | 28 |
| 40 | −80 | 96 | 26 |
| 120 | −60 | 102 | 20 |
| 800 | −50 | 98 | 31 |

From the table, it is clear that the filaments involving a draft ratio of 1.2 show a breaking strength considerably inferior to that displayed by the filaments involving draft ratios of 3.2 or 40, although the other conditions of treatment are the same. It is also seen that the filaments which undergo the stretching treatment at 0°C show a lower degree of breaking strength in spite of a higher draft ratio.

EXAMPLE 10

The apparatus of Example 7 was used. The freezing bath used ethanol at about −100°C. The interior of the vessel containing the rotary drum was maintained at −80°C. A fiber grade polyethylene melted by heating to 280°C was melt spun through the spinneret and then introduced to be frozen in the freezing bath disposed at a distance of 5cm from the spinneret. The spinneret had orifices 0.3mm in diameter. The output rate of filaments through the spinneret per orifice and the take-up speed of filaments on the rotary drum were so adjusted that the filaments were drafted at draft ratios of 1.6, 3.5, 50, 110 and 900.

The frozen filaments thus obtained were stretched at the varying temperatures shown in Table 8 until their critical point. They were subsequently subjected to a heat treatment by being elevated to 80°C while they were maintained in the resultant taut state. The resultant filaments were tested for breaking strength and elongation under conditions of 20°C of temperature and 65% of humidity. The results are shown in Table 8.

Table 8

| Draft ratio | Temperature of stretching treatment (°C) | Breaking strength (kg/mm²) | Elongation % |
|---|---|---|---|
| 1.6 | −25 | 76 | 30 |
| 3.5 | −25 | 92 | 27 |
| 50 | −10 | 68 | 28 |
| 50 | −25 | 95 | 31 |
| 50 | −80 | 98 | 33 |
| 110 | −80 | 101 | 29 |
| 900 | −100 | 99 | 27 |

From the table, it is seen that the filaments involving a draft ratio of 1.6 show no improvement in breaking strength, even if the stretching treatment is given at −25°C. It is also clear that the filaments which undergo the stretching treatment at −10°C similarly show unimproved breaking strength, in spite of a high draft ratio of 50.

EXAMPLE 11

The apparatus of Example 7 was used. The freezing bath used n-hexanone at about −75°C. The interior of the vessel containing the rotary drum was maintained at −40°C. A fiber grade nylon 66 melted by heating to 280°C was melt spun through the spinneret and then introduced to be frozen in the freezing bath disposed at a distance of 5cm from the spinneret. The spinneret had orifices 0.5mm in diameter. The output rate of filaments through the spinneret per orifice and the take-up speed of filaments on the rotary drum were so adjusted that the filaments were drafted at draft ratios of 1.7, 3.8, 35, 100 and 850.

The frozen filaments thus obtained were stretched to their critical point at the varying temperatures shown in Table 9 and subsequently subjected to a heat treatment by being elevated to 150°C while they were maintained in the resultant taut state. The filaments which had undergone the treatment were tested for breaking strength and elongation under conditions of 20°C of temperature and 65% of humidity. The results are shown in Table 9.

Table 9

| Draft ratio | Temperature of stretching treatment (°C) | Breaking strength (kg/mm²) | Elongation % |
|---|---|---|---|
| 1.7 | 10 | 84 | 31 |
| 3.8 | 10 | 95 | 32 |
| 35 | 30 | 86 | 30 |
| 35 | 10 | 96 | 28 |
| 35 | −10 | 96 | 33 |
| 100 | −20 | 100 | 29 |
| 850 | −50 | 99 | 30 |

As is clear from the table, the filaments involving a draft ratio of 3.8 show a considerable degree of improvement in breaking strength as compared with those involving a draft ratio of 1.7, although they are stretched at the same temperature. Increase of the draft ratio from 3.8 to 35 brings about substantially no improvement in breaking strength. The filaments which undergo the stretching treatment at 30°C still show a lower degree of breaking strength, suggesting that the stretching treatment should desirably be performed at temperatures below 10°C.

What we claim is:

1. A method for the manufacture of filaments of crystalline plastic selected from the group consisting essentially of polyamide, polyolefin and polyester which comprises the steps of 1. forming molten filaments of the crystalline plastic by melt spinning said crystalline plastic from a spinneret;
2. drafting said molten filaments at a mathematical draft of from 3 to 1000;

3. instantaneously cooling said drafted, molten filaments to a temperature from −30° to −100°C, thereby forming amorphous, orientable. glassy filaments;
4. stretching said amorphous, orientable, glassy filaments from 4 to 8 times at 10° to −80°C; and
5. elevating the temperature of the filaments of step (4) so as to induce crystallization wherein the method of manufacture of steps (1) – (5) is continuous.

2. The method of claim 1, wherein the filaments of step (5) are stretched.

* * * * *